US009338548B2

(12) United States Patent
Li et al.

(10) Patent No.: US 9,338,548 B2
(45) Date of Patent: May 10, 2016

(54) MOBILE DEVICE AND CORRESPONDING NOISE-CANCELING EARPHONE

(71) Applicant: MERRY ELECTRONICS (SHENZHEN) CO., LTD., ShenZhen (CN)

(72) Inventors: Hung-Yuan Li, New Taipei (TW); Chun-Yuan Lee, New Taipei (TW); Chien-Min Chen, New Taipei (TW)

(73) Assignee: MERRY ELECTRONICS (SHENZHEN) CO., LTD., Shenzhen (CN)

( * ) Notice: Subject to any disclaimer, the term of this patent is extended or adjusted under 35 U.S.C. 154(b) by 191 days.

(21) Appl. No.: 14/247,563

(22) Filed: Apr. 8, 2014

(65) Prior Publication Data

US 2015/0289055 A1 Oct. 8, 2015

(51) Int. Cl.
*H04R 3/00* (2006.01)
*H04R 1/10* (2006.01)

(52) U.S. Cl.
CPC ..... *H04R 3/002* (2013.01); *H04R 1/10* (2013.01); *H04R 2499/11* (2013.01)

(58) Field of Classification Search
None
See application file for complete search history.

(56) References Cited

U.S. PATENT DOCUMENTS

| | | | | |
|---|---|---|---|---|
| 8,548,175 | B2 * | 10/2013 | Im | H04R 1/1041 381/74 |
| 9,049,301 | B2 * | 6/2015 | Im | |
| 9,112,352 | B2 * | 8/2015 | Chen | H02H 3/087 |
| 9,161,124 | B2 * | 10/2015 | Xiao | H04R 3/00 |
| 9,197,957 | B2 * | 11/2015 | Zhang | H04R 1/1041 |
| 2010/0303251 | A1 * | 12/2010 | Im | H04R 1/1041 381/74 |
| 2012/0051562 | A1 * | 3/2012 | Kim | H04R 3/00 381/122 |
| 2013/0070930 | A1 * | 3/2013 | Johnson | H04R 3/007 381/57 |

* cited by examiner

*Primary Examiner* — Paul Huber
(74) *Attorney, Agent, or Firm* — WPAT, P.C.; Justin King

(57) ABSTRACT

A mobile device includes a processing module, an external connection interface and a current monitoring unit. The external connection interface is electrically connected to the processing module and includes a first pin, a second pin and a third pin. The first pin is configured to transmit a first speaker signal and the second pin is configured to transmit a second speaker signal. The current monitoring unit is electrically connected to the processing module and the third pin of the external connection interface and configured to monitor a current state of the third pin and feedback the monitored current state to the processing module. The processing module is configured to provide one of a plurality of different voltage levels to the third pin according to the monitored current state. A noise-canceling earphone is also disclosed.

8 Claims, 3 Drawing Sheets

MOBILE DEVICE AND CORRESPONDING NOISE-CANCELING EARPHONE

FIELD OF THE INVENTION

The present invention relates to a mobile device and a corresponding noise-canceling earphone, and more particularly to a mobile device capable of supplying an operation power to a being-connected noise-canceling earphone and a noise-canceling earphone capable of receiving an operation power from a being-connected mobile device.

BACKGROUND OF THE INVENTION

In recent years, with increasingly powerful functions, mobile devices have gradually replaced the music players, cameras, electronic game players and other electronic devices, for playing music, taking pictures and playing games. However, when using an earphone for listening music, a user may be affected by the external noises, such as passers-talk sound and traffic noise. Thus, there is a strong demand for noise-canceling earphone which is capable of reducing or even eliminating the external noises. However, the conventional noise-canceling earphone usually needs an additional battery to supply the operation power for the noise-canceling earphone; consequentially, the noise-canceling earphone may have relatively-large size and increasing weight. In addition, because the operation power is provided by batteries, the issue of poor noise canceling effect caused by insufficient operation power may occur. Thus, for a user, it is not such convenient to use the conventional noise-canceling earphone.

SUMMARY OF THE INVENTION

The present invention provides a mobile device, which includes a processing module, an external connection interface and a current monitoring unit. The external connection interface is electrically connected to the processing module and includes a first pin, a second pin and a third pin. The first pin is configured to transmit a first signal and the second pin is configured to transmit a second signal. The current monitoring unit is electrically connected to the processing module and the third pin of the external connection interface and configured to monitor a current state of the third pin and transmit the monitored current state to the processing module. The processing module is configured to provide one of a plurality of different voltage levels to the third pin according to the monitored current state.

The present invention further provides a noise-canceling earphone, which includes an earphone connection interface, a first speaker, a second speaker, a microphone, a comparison module, a noise-canceling switch and a noise-canceling circuit. The earphone connection interface includes a first pin, a second pin and a third pin. The first pin is configured to receive a first speaker signal and the second pin is configured to receive a second speaker signal. The first speaker is electrically connected to the first pin. The second speaker is electrically connected to the second pin. The earphone microphone is electrically connected to the third pin. The comparison module is electrically connected to the third pin and configured to receive a voltage level and compare the voltage level with a predetermined threshold voltage level. The noise-canceling switch is electrically connected to the third pin and the comparison module. The noise-canceling switch is turned on when the comparison module indicates that the voltage level is equal to or higher than the predetermined threshold voltage level. The noise-canceling circuit is electrically connected to the noise-canceling switch, the first speaker and the second speaker. The noise-canceling circuit is configured to receive the voltage level as an operation power thereof. The noise-canceling microphone is electrically connected to the noise-canceling circuit.

In summary, by determining whether there is an earphone being connected to the mobile device through monitoring the current state at the node A, determining the type of the earphone being-connected earphone through monitoring the current state at the node B, and supplying a corresponding voltage level to the being-connected earphone according to the determined type of the being-connected earphone, the earphone (for example, a noise-canceling earphone) can receive the operation power from the mobile device instead of requiring any external individual power source (for example, a battery). Thus, the earphone of the present invention has significantly-reduced size and weight. In addition, the issue of poor noise canceling effect caused by insufficient operation power is avoided; and consequentially, the earphone of the present invention is more convenient to be used.

For making the above and other purposes, features and benefits become more readily apparent to those ordinarily skilled in the art, the preferred embodiments and the detailed descriptions with accompanying drawings will be put forward in the following descriptions.

BRIEF DESCRIPTION OF THE DRAWINGS

The present invention will become more readily apparent to those ordinarily skilled in the art after reviewing the following detailed description and accompanying drawings, in which.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
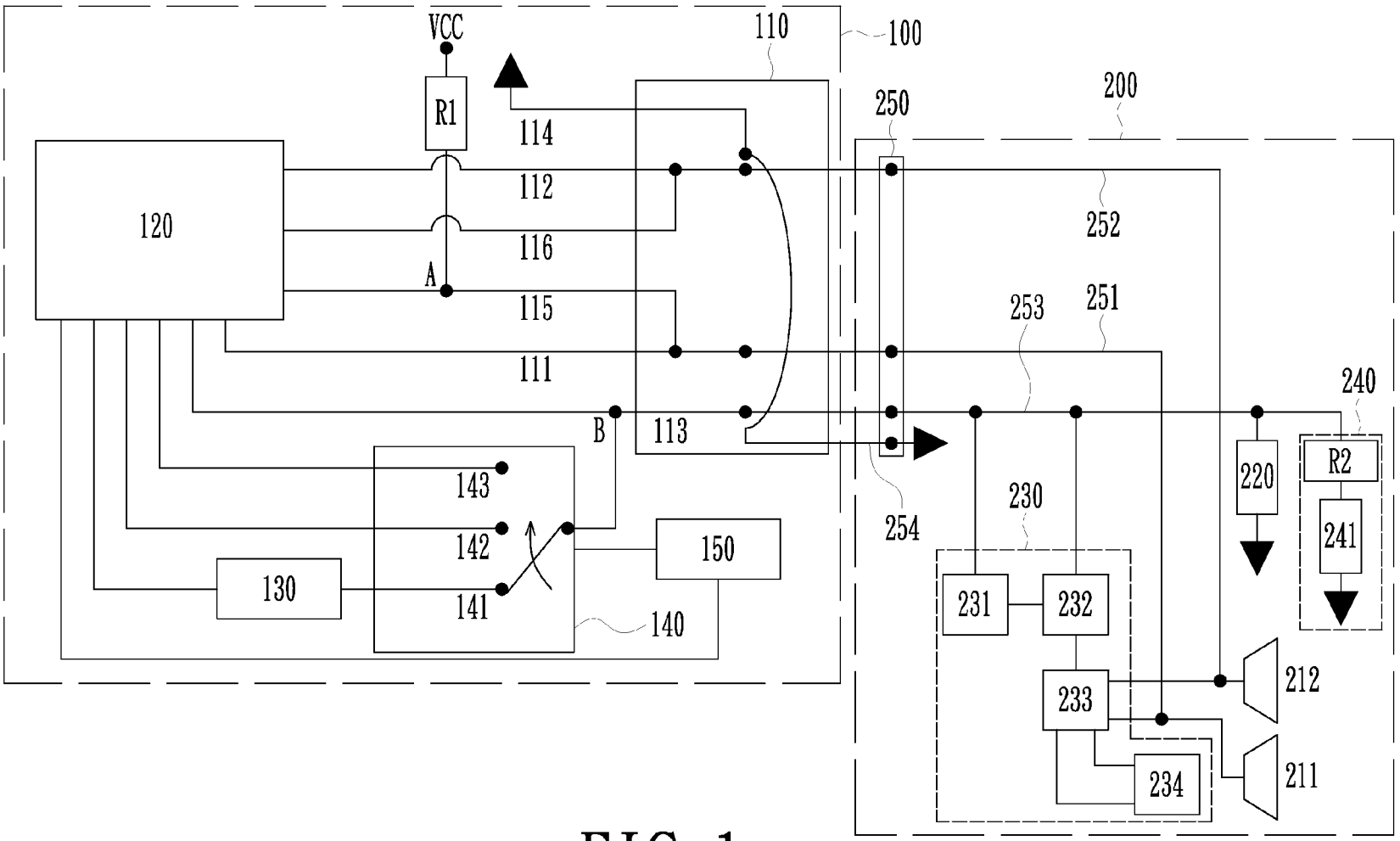
FIG. 1 is a schematic diagram of a system including a mobile device and a corresponding noise-canceling earphone in accordance with a first embodiment of the present invention.

FIG. 1 is a schematic diagram of a system including a mobile device 100 and a corresponding noise-canceling earphone 200 in accordance with a first embodiment of the present invention. As shown, the mobile device 100 in this embodiment includes an external connection interface 110, a processing module 120, a current monitoring unit 130, a switch module 140 and a switch control module 150. The external connection interface 110 is configured to provide a connection interface, through which the noise-canceling earphone 200 can be electrically connected to the mobile device 100. The external connection interface 110 includes a first pin 111, a second pin 112, a third pin 113, a fourth pin 114, a fifth pin 115 and a sixth pin 116; wherein the first pin 111, the second pin 112, the third pin 113, the fifth pin 115 and the sixth pin 116 are electrically connected to the processing module 120. The first pin 111 is configured to transmit a first speaker signal derived from the processing module 120. The second pin 112 is configured to transmit a second speaker signal derived from the processing module 120. The first pin 111 is further electrically connected to a first resistor R1 through the fifth pin 115. The first resistor R1 is electrically connected to an external power source VCC, which is configured to provide a specific voltage level to the first pin 111. The second pin 112 and the sixth 116 are electrically connected with each other. The fourth pin 114 is electrically connected to a reference voltage level which may be 0 volts.

The switch module 140 is electrically connected to the third pin 113 of the external connection interface 110. The switch module 140 includes a first connection port 141, a second connection port 142 and a third connection port 143. The second connection port 142 and the third connection port 143 are directly electrically connected to the processing module 120. The processing module 120 is further configured to output a plurality of voltage levels though the first connection port 141, the second connection port 142 and the third connection port 143; wherein the plurality of voltage levels at least include a first voltage level, a second voltage level and a third voltage level. In one embodiment, the first voltage level may be 0 volts; the second voltage level may be 2.1 volts; and the third voltage level may be 3 volts. The switch module 140 is further electrically connected to the switch control module 150. The switch control module 150 is configured to receive a switch control signal from the processing module 120 and selectively switch, according to the received switch control signal, the switch module 140 to electrically connect the first connection port 141, the second connection port 142 or the third connection port 143 to the third pin 113 and thereby output the voltage level at the selected connection port to the third pin 113.

The current monitoring unit 130 is electrically connected between the processing module 120 and the first connection port 141 of the switch module 140; thus, the current monitoring unit 130 is electrically connected to the third pin 113 when the first connection port 142 is selected to be electrically connected to the third pin 113. The current monitoring unit 130 is configured to provide the aforementioned third voltage level to the third pin 113, sense the current state of the third pin 113, and feedback the sensing result to the processing module 120. Consequentially, the processing module 120 is further configured to determined the type of the earphone (for example, a noise-canceling earphone) being connected to the mobile device 100 according to the sensing result of the current state at the third pin 113. Then, according to the determined earphone type, the processing module 120 issues a corresponding switch control signal to the switch control module 150 to control the switch module 140 to switch to the corresponding connection port. Thus, the mobile device 100 of the present invention can supply a corresponding suitable voltage level functioned as an operation power for the being-connected earphone according to the determined type of the being-connected earphone.

As shown in FIG. 1, the noise-canceling earphone 200 in this embodiment, corresponding to the mobile device 100, includes an earphone microphone 220, an earphone connection interface 250, a first speaker 211, a second speaker 212 and a noise-canceling module 230. The noise-canceling module 230 includes a comparison module 231, a noise-canceling switch 232 and a noise-canceling circuit 233. The earphone connection interface 250 includes a first pin 251, a second pin 252, a third pin 253 and a fourth pin 254. When the noise-canceling earphone 200 is connected to the mobile device 100, the first pin 251 of the noise-canceling earphone 200 is electrically connected to the first pin 111 of the mobile device 100 and is configured to receive the first speaker signal from the mobile device 100 and then transmit the first speaker signal to the first speaker 211; the second pin 252 of the noise-canceling earphone 200 is electrically connected to the second pin 112 of the mobile device 100 and is configured to receive the second speaker signal from the mobile device 100 and then transmit the second speaker signal to the second speaker 212; the third pin 253 of the noise-canceling earphone 200 is electrically connected to the third pin 113 of the mobile device 100; and the fourth pin 254 of the noise-canceling earphone 200 is electrically connected to the fourth pin 114 of the mobile device 100 and is configured to receive the reference voltage level.

The comparison module 231 is electrically connected to the third pin 253 and the noise-canceling switch 232. The comparison module 231 is configured to receive the voltage level at the third pin 253, compare the received voltage level with a threshold voltage level (in this embodiment, 3 volts, for example) and then either turn on or turn off the noise-canceling switch 232 according to the comparison result. In one embodiment, the comparison module 231 turns on the noise-canceling switch 232 if the comparison result indicates that the voltage level at the third pin 253 is equal to or higher than the threshold voltage level; and consequentially the voltage level at the third pin 253 can be transmitted to the noise-canceling circuit 233 through the turned-on noise-canceling switch 232 and the noise-canceling circuit 233 can start to work when the voltage level functioned as an operation power is received. Alternatively, the comparison module 231 turns off the noise-canceling switch 232 if the comparison result indicates that the voltage level at the third pin 253 is lower than the threshold voltage level; and consequentially the noise-canceling circuit 233 stops working due to the voltage level at the third pin 253 functioned as an operation power cannot be transmitted to the noise-canceling circuit 233 through the turned-off noise-canceling switch 232. In addition, the noise-canceling circuit 233 is electrically connected to the first speaker 211, the second speaker 212 and a noise-canceling microphone 234. The noise-canceling circuit 233 is configured to cancel the external noises inputted through the noise-canceling microphone 234. The earphone microphone 220, electrically connected between the third pin 253 and the reference voltage level, is configured to receive voice information inputted from a user. The noise-canceling earphone 200 further includes a voice-communication controlling module 240 electrically connected between the third pin 253 and the reference voltage level. The voice-communication controlling module 240 includes a second resistor R2 and a voice-communication controlling switch 241. Specifically, a first terminal of the second resistor R2 is electrically connected to the third pin 253; a second terminal of the second resistor R2 is electrically connected to a first terminal of the voice-communication controlling switch 241; and a second terminal of the voice-communication controlling switch 241 is electrically connected to the reference voltage level. When the voice-communication controlling switch 241 is turned on, a user can input voice information through the earphone microphone 220.

The operation of the mobile device 100 and the corresponding noise-canceling earphone 200 of the present invention will be described in detailed as follow. When the mobile device 100 and the corresponding noise-canceling earphone 200 are connected to each other, the first pin 251, the second pin 252, the third pin 253 and the fourth pin 254 of the noise-canceling earphone 200 are electrically connected to the first pin 111, the second pin 112, the third pin 113 and the fourth pin 114 of the mobile device 100, respectively. It is to be noted that meanwhile the first pin 111 and the fifth pin 115 of the mobile device 100 are automatically disconnected to each other due to the structural design; and consequentially the node A, electrically connected between the first resistor R1 and the fifth pin 115, will have a current change due to the associated resistance is changed. Thus, by sensing the current state at the node A, the processing module 120 can determine that whether there is an earphone being connected to the mobile device 100. When determining that there is an earphone being connected to the mobile device 100, the processing unit 120 first controls the current monitoring unit 130 to provide the aforementioned third voltage level to the third pin 113 through the third connection port 141 of the switch module 140, to sense the current state of the node B which is electrically connected to the third pin 113 and the switch module 140, and to feedback the sensing result to the processing module 120. Consequentially, the processing module 120 can determine the type of the earphone (for example, a noise-canceling earphone) being connected to the mobile device 100 according to the sensing result of the current state at node B.

When determining that the earphone currently connected to the mobile device 100 is the noise-canceling earphone 200, the processing module 120 issues a specific switch control signal to the switch control module 150. Then the switch control module 150 controls, according to the received switch control signal, the switch module 140 to switch to, for example, the second connection port 142 and thereby electrically connect the second connection port 142 to the third pin 113. Then, the processing module 120 controls the second connection port 142 to output the third voltage level. Thus, the third voltage level is provided from the mobile device 100 to the noise-canceling earphone 200 while the noise-canceling earphone 200 is electrically connected to the mobile device 100. Meanwhile, because the current monitoring unit 130 is no longer electrically connected to the third pin 113 through the first connection port 141 of the switch module 140 and consequentially the current transmitted from the current monitoring unit 130 to the processing module 120 has a changed current state, the processing module 120 can determine that the switch operation (for example, switching the switch module 140 from the first connection port 141 to the second connection port 142) of the switch module 140 is completed according to the change of the received current state.

When the aforementioned third voltage level is supplied to the noise-canceling earphone 200 through the third pin 253 thereof, the comparison module 231 compares the third voltage level with the threshold voltage level and turns on the noise-canceling switch 232 due to the third voltage level is equal to the threshold voltage level. Consequentially, the noise-canceling circuit 233 can receive the third voltage level from the third pin 113 through the turned-on noise-canceling switch 232; wherein the third voltage level herein is functioned as an operation power of the noise-canceling circuit 233 and the noise-canceling circuit 233 starts to work when the third voltage level is received. Accordingly, the noise canceling function on the noise-canceling microphone 234 is achieved. When a user wants to use the earphone microphone 220 for a voice communication, he or she only needs to press the voice-communication controlling switch 241 to electrically connect one terminal of the second resistor R2 to the reference voltage level directly. As a result, the impedance associated with the node B is changed and correspondingly the current flowing through the node B is changed; and the processing module 120 can determine that the user is trying to make a voice communication through the earphone microphone 220 according to the changed current state at the node B. Then, the processing module 120 issues a specific switch control signal to the switch control module 150; and the switch control module 150 controls, according to the received switch control signal, the switch module 140 to switch to, for example, the third connection port 143 and thereby electrically connect the third connection port 143 to the third pin 113. Then, the processing module 120 controls the third connection port 143 to output the aforementioned second voltage level functioned as an operation power for the earphone microphone 220. Thus, the earphone microphone 220 starts to work when the second voltage level is received and consequentially the voice information inputted through the earphone microphone 220 can be transmitted back to the processing module 120 through the third connection port 143.

When the noise-canceling earphone 200 is disconnected from the mobile device 100, the first pin 111 of the mobile device 100 is disconnected from the first pin 251 of the noise-canceling earphone 200 and the fifth pin 115 is automatically electrically connected to the first pin 111; consequentially, the current at the node A is changed and the processing module 120 can determine that the noise-canceling earphone 200 is no longer connected to the mobile device 100 according to the change of the current state at the node A. The processing module 120 then issues a specific switch control signal to the switch control module 150; and the switch control module 150 controls, according to the received switch control signal, the switch module 140 to switch to, for example, the first connection port 141 and thereby electrically connect the first connection port 141 to the third pin 113. Thus, the current monitoring unit 130 is electrically connected to the third pin 113 again and the mobile device 100 is back to an initial state again.

Figure 2:
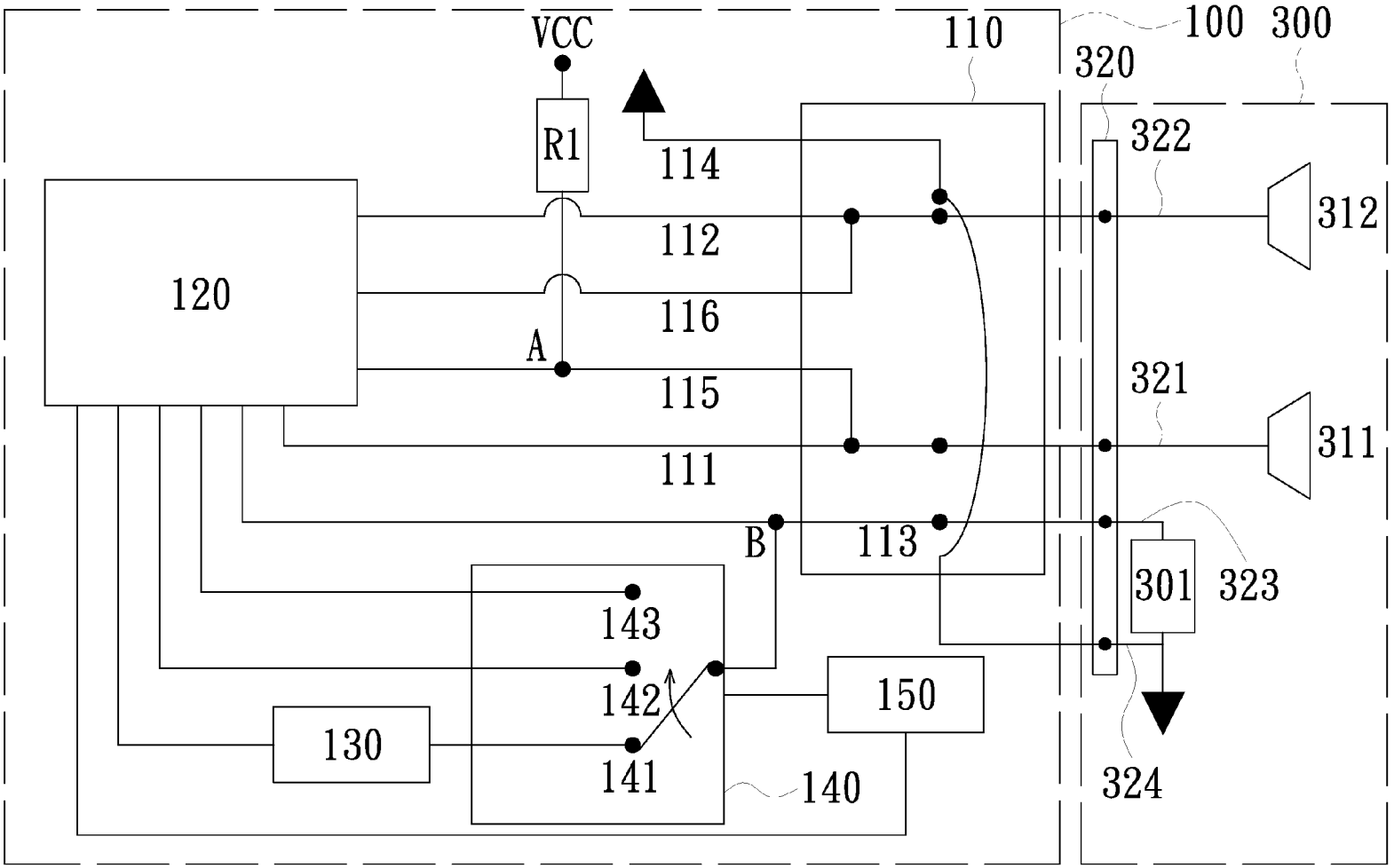
FIG. 2 is a schematic diagram of a system including a mobile device and a corresponding noise-canceling earphone in accordance with a second embodiment of the present invention.

FIG. 2 is a schematic diagram of a system including the mobile device 100 and a corresponding earphone 300 in accordance with a second embodiment of the present invention. As shown, the function and the configuration of the mobile device 100 have been described above, and no redundant detail is to be given herein. The main difference between the first and second embodiments is that the earphone 300 in this embodiment does not include the aforementioned noise-canceling module 230 and the voice-communication controlling module 240 described in the first embodiment. The earphone 300 in this embodiment includes an earphone connection interface 320, an earphone microphone 301, a first speaker 311 and a second speaker 312. The earphone connection interface 320 includes a first pin 321, a second pin 322, a third pin 323 and a fourth pin 324. When the earphone 300 is connected to the mobile device 100, the first pin 321 of the earphone 300 is electrically connected to the first pin 111 of the mobile device 100 and is configured to receive the first speaker signal from the mobile device 100 and then transmit the first speaker signal to the first speaker 311; the second pin 322 of the earphone 300 is electrically connected to the second pin 112 of the mobile device 100 and is configured to receive the second speaker signal from the mobile device 100 and then transmit the second speaker signal to the second speaker 312; the third pin 323 of the earphone 300 is electrically connected to the third pin 113 of the mobile device 100; and the fourth pin 324 of the earphone 300 is electrically connected to the fourth pin 114 of the mobile device 100. The earphone microphone 301 is electrically connected between the third pin 323 and the fourth pin 114 of the mobile device 100. The fourth pin 324 is configured to receive the aforementioned reference voltage level.

The operation of the mobile device 100 and the corresponding earphone 300 of the present invention will be described in detailed as follow. When the mobile device 100 and the corresponding earphone 300 are connected to each other, the first pin 321, the second pin 322, the third pin 323 and the fourth pin 324 of the earphone 300 are electrically connected to the first pin 111, the second pin 112, the third pin 113 and the fourth pin 114 of the mobile device 100, respectively. It is to be noted that meanwhile the first pin 111 and the fifth pin 115 of the mobile device 100 are automatically disconnected to each other due to the structural design; and consequentially the node A, electrically connected between the first resistor R1 and the fifth pin 115, will have a current change due to the associated resistance is changed. Thus, by sensing the current state at the node A, the processing module 120 can determine that whether there is an earphone being connected to the mobile device 100. When determining that there is an earphone being connected to the mobile device 100, the processing unit 120 first controls the current monitoring unit 130 to provide the aforementioned third voltage level to the third pin 113 through the third connection port 141 of the switch module 140, to sense the current state of the node B which is electrically connected to the third pin 113 and the switch module 140, and to feedback the sensing result to the processing module 120. Consequentially, the processing module 120 can determine the type of the earphone (for example, the earphone 300 having an earphone microphone 301) being connected to the mobile device 100 according to the sensing result of the current state at node B. It is to be noted that the current state at the node B in this embodiment is different with that in the first embodiment due to the phone 300 in this embodiment has a circuit structure different with that of the noise-canceling earphone 200 in the first embodiment.

When determining that the earphone currently connected to the mobile device 100 is the earphone 300, the processing module 120 issues a specific switch control signal to the switch control module 150. Then the switch control module 150 controls, according to the received switch control signal, the switch module 140 to switch to, for example, the third connection port 143 and thereby electrically connect the third connection port 143 to the third pin 113. Then, the processing module 120 controls the third connection port 143 to output the aforementioned second voltage level functioned as the operation power of the earphone microphone 301. Thus, the second voltage level is provided from the mobile device 100 to the earphone 300 while the earphone 300 is electrically connected to the mobile device 100. Thus, the earphone microphone 301 starts to work when the second voltage level is received and consequentially the voice information inputted through the earphone microphone 301 can be transmitted back to the processing module 120 through the third connection port 143. Meanwhile, because the current monitoring unit 130 is no longer electrically connected to the third pin 113 through the first connection port 141 of the switch module 140 and consequentially the current transmitted from the current monitoring unit 130 to the processing module 120 has a changed current state, the processing module 120 can determine that the switch operation (for example, switching the switch module 140 from the first connection port 141 to the third connection port 143) of the switch module 140 is completed according to the change of the received current state.

When the earphone 300 is disconnected from the mobile device 100, the first pin 111 of the mobile device 100 is disconnected from the first pin 321 of the earphone 300 and the fifth pin 115 is automatically electrically connected to the first pin 111; consequentially, the current at the node A is changed and the processing module 120 can determine that the earphone 300 is no longer connected to the mobile device 100 according to the change of the current state at the node A. The processing module 120 then issues a specific switch control signal to the switch control module 150; and the switch control module 150 controls, according to the received switch control signal, the switch module 140 to switch to, for example, the first connection port 141 and thereby electrically connect the first connection port 141 to the third pin 113. Thus, the current monitoring unit 130 is electrically connected to the third pin 113 again and the mobile device 100 is back to an initial state again.

Figure 3:
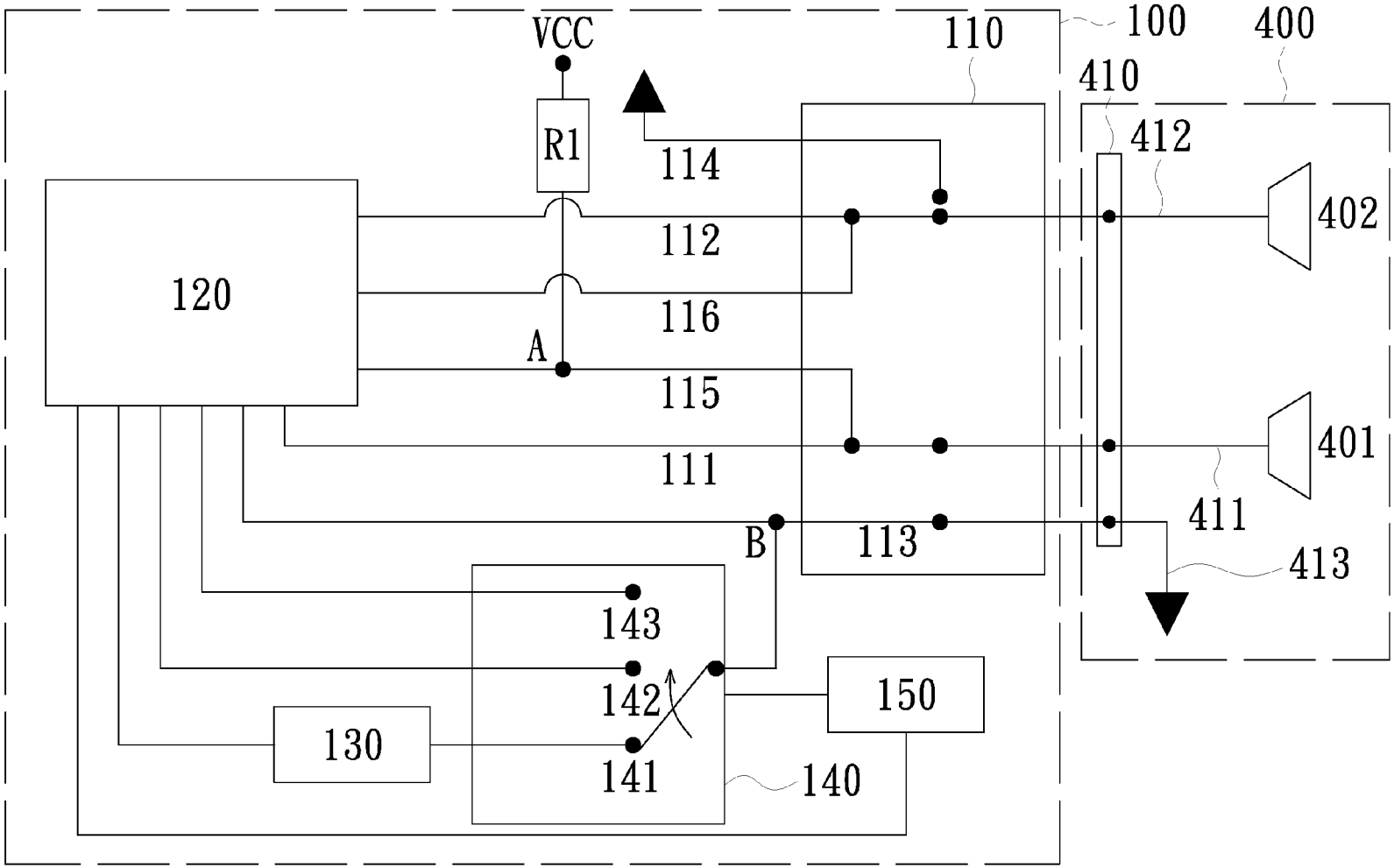
FIG. 3 is a schematic diagram of a system including a mobile device and a corresponding noise-canceling earphone in accordance with a third embodiment of the present invention.

FIG. 3 is a schematic diagram of a system including the mobile device 100 and a corresponding earphone 400 in accordance with a third embodiment of the present invention. As shown, the function and the configuration of the mobile device 100 have been described above, and no redundant detail is to be given herein. The main difference between the first and third embodiments is that the earphone 400 in this embodiment does not include the aforementioned noise-canceling module 230, the voice-communication controlling module 240 and the earphone microphone 220 described in the first embodiment. The earphone 400 in this embodiment includes an earphone connection interface 410, a first speaker 401 and a second speaker 402. The earphone connection interface 410 includes a first pin 411, a second pin 412 and a third pin 413. The first pin 411 is electrically connected to the first speaker 401; the second pin 412 is electrically connected to the second speaker 402; and the third pin 413 is not electrically connected to any load. When the earphone 400 is connected to the mobile device 100, the first pin 411 of the earphone 400 is electrically connected to the first pin 111 of the mobile device 100 and is configured to receive the first speaker signal from the mobile device 100 and then transmit the first speaker signal to the first speaker 401; the second pin 412 of the earphone 400 is electrically connected to the second pin 112 of the mobile device 100 and is configured to receive the second speaker signal from the mobile device 100 and then transmit the second speaker signal to the second speaker 402; the third pin 413 of the earphone 400 is electrically connected to the third pin 113 of the mobile device 100.

The operation of the mobile device 100 and the corresponding earphone 400 of the present invention will be described in detailed as follow. When the mobile device 100 and the corresponding earphone 400 are connected to each other, the first pin 411, the second pin 412 and the third pin 413 of the earphone 400 are electrically connected to the first pin 111, the second pin 112 and the third pin 113 of the mobile device 100, respectively. It is to be noted that meanwhile the first pin 111 and the fifth pin 115 of the mobile device 100 are automatically disconnected to each other due to the structural design; and consequentially the node A, electrically connected between the first resistor R1 and the fifth pin 115, will have a current change due to the associated resistance is changed. Thus, by sensing the current state at the node A, the processing module 120 can determine that whether there is an earphone being connected to the mobile device 100. When determining that there is an earphone being connected to the mobile device 100, the processing unit 120 first controls the current monitoring unit 130 to provide the aforementioned third voltage level to the third pin 113 through the third connection port 141 of the switch module 140, to sense the current state of the node B which is electrically connected to the third pin 113 and the switch module 140, and to feedback the sensing result to the processing module 120. Consequentially, the processing module 120 can determine the type of the earphone (for example, the earphone 400) being connected to the mobile device 100 according to the sensing result of the current state at node B. It is to be noted that the current state at the node B in this embodiment is different with that in the first and second embodiments due to the phone 400 in this embodiment has a circuit structure different with that of the noise-canceling earphone 200 in the first embodiment and the earphone 300 in the second embodiment.

When determining that the earphone currently connected to the mobile device 100 is the earphone 400, the processing module 120 issues a specific switch control signal to the switch control module 150. Then the switch control module 150 controls, according to the received switch control signal, the switch module 140 to switch to, for example, the second connection port 142 and thereby electrically connect the second connection port 142 to the third pin 113. Then, the processing module 120 controls the second connection port 142 to output, for example, the reference voltage level due to the earphone 400 only includes the first speaker 401 and the second speaker 402, the third pin 413 is electrically connected to no load and no any additional operation power is needed. Meanwhile, because the current monitoring unit 130 is no longer electrically connected to the third pin 113 through the first connection port 141 of the switch module 140 and consequentially the current transmitted from the current monitoring unit 130 to the processing module 120 has a changed current state, the processing module 120 can determine that the switch operation (for example, switching the switch module 140 from the first connection port 141 to the second connection port 142) of the switch module 140 is completed according to the change of the received current state.

When the earphone 400 is disconnected from the mobile device 100, the first pin 111 of the mobile device 100 is disconnected from the first pin 411 of the earphone 400 and the fifth pin 115 is automatically electrically connected to the first pin 111; consequentially, the current at the node A is changed and the processing module 120 can determine that the earphone 400 is no longer connected to the mobile device 100 according to the change of the current state at the node A. The processing module 120 then issues a specific switch control signal to the switch control module 150; and the switch control module 150 controls, according to the received switch control signal, the switch module 140 to switch to, for example, the first connection port 141 and thereby electrically connect the first connection port 141 to the third pin 113. Thus, the current monitoring unit 130 is electrically connected to the third pin 113 again and the mobile device 100 is back to an initial state again.

In summary, by determining whether there is an earphone being connected to the mobile device through monitoring the current state at the node A, determining the type of the earphone being-connected earphone through monitoring the current state at the node B, and supplying a corresponding voltage level to the being-connected earphone according to the determined type of the being-connected earphone, the earphone (for example, a noise-canceling earphone) can receive the operation power from the mobile device instead of requiring any external individual power source (for example, a battery). Thus, the earphone of the present invention has significantly-reduced size and weight. In addition, the issue of poor noise canceling effect caused by insufficient operation power is avoided; and consequentially, the earphone of the present invention is more convenient to be used.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A mobile device, comprising:

a processing module;

an external connection interface, electrically connected to the processing module and comprising a first pin, a second pin and a third pin, wherein the first pin is configured to transmit a first signal and the second pin is configured to transmit a second signal; and a current monitoring unit, electrically connected to the processing module and the third pin of the external connection interface and configured to monitor a current state of the third pin and transmit the monitored current state to the processing module, wherein the processing module is configured to provide one of a plurality of different voltage levels to the third pin according to the monitored current state.

2. The mobile device according to claim 1, further comprising a switch module electrically connected to the processing module and the external connection interface, the switch module being configured to switch a selected voltage level to the third pin according to the monitored current state.

3. The mobile device according to claim 2, further comprising a switch control module electrically connected to the processing module and the switch module, the switch control module being configured to control the switch module according to a switch control signal emitted from the processing module.

4. The mobile device according to claim 2, wherein the current monitoring unit is further electrically connected to the switch module, and an electrical connection between the current monitoring unit and the third pin of the external connection interface is realized through the switch module.

5. The mobile device according to claim 1, wherein the plurality of different voltage levels comprise at least a first voltage level, a second voltage level and a third voltage level.

6. The mobile device according to claim 5, wherein the current monitoring unit is further configure to transmit the third voltage level to the third pin of the external connection interface for monitoring the current state of the third pin.

7. The mobile device according to claim 1, wherein the first pin is electrically connected to an external power source through a first resistor.

8. The mobile device according to claim 1, wherein the external connection interface further comprises a fourth pin configured to receive a reference voltage level.

* * * * *